US005706519A

United States Patent [19]

Cooper

[11] Patent Number: 5,706,519

[45] Date of Patent: Jan. 13, 1998

[54] WATERPROOF SPORTS GLOVE

[76] Inventor: John Scott Cooper, 4013 Lurline Dr., Honolulu, Hi. 96816

[21] Appl. No.: 419,359

[22] Filed: Apr. 10, 1995

[51] Int. Cl.[6] ..... A41D 13/10

[52] U.S. Cl. ..... 2/19; 2/16

[58] Field of Search ..... 2/19, 16, 18, 161.1, 2/167, 168; 273/25, 26 C

[56] References Cited

U.S. PATENT DOCUMENTS

| | | | |
|---|---|---|---|
| 1,473,849 | 11/1923 | Goldsmith | 2/19 |
| 2,109,974 | 3/1938 | O'Hara | 2/19 |
| 2,625,686 | 1/1953 | Latina | 2/19 |
| 3,026,531 | 3/1962 | Holaday | 2/167 |
| 4,279,681 | 7/1981 | Klimezk | 2/19 |
| 4,891,845 | 1/1990 | Hayes | 2/19 |
| 4,896,376 | 1/1990 | Miner | 2/19 |
| 5,167,038 | 12/1992 | Rinehart | 2/169 |
| 5,402,537 | 4/1995 | Kolada | 2/19 |
| 5,448,776 | 9/1995 | Caruso | 2/19 |

*Primary Examiner*—C. D. Crowder
*Assistant Examiner*—Larry D. Worrell, Jr.
*Attorney, Agent, or Firm*—Adams & Wilks

[57] ABSTRACT

A waterproof sports glove comprises a pair of superposed flexible pieces of substantially water-impervious material connected and sealed together along the marginal edge portions thereof to define a glove body having an open lower section configured to receive therethrough the hand of a user during use of the glove. The glove body is provided with two finger sections separated from one another by a cut-out portion, and each of the finger sections comprises at least one finger compartment for receiving therein at least one finger of the user's hand. A web of a substantially water-impervious material is disposed within the cut-out portion and interconnects the two finger sections.

39 Claims, 1 Drawing Sheet

WATERPROOF SPORTS GLOVE

BACKGROUND OF THE INVENTION

1. Field of the Invention

The present invention relates generally to a waterproof sports glove and, more particularly, to a flexible sports glove constructed of water-impervious material for catching tennis-like balls.

2. Background of the Invention

A leather baseball glove is typically worn by an individual to catch a hard baseball. However, a hard baseball and leather glove are oftentimes inappropriate for use near crowds or indoors, particularly when the baseball is propelled at high speeds. Furthermore, during training of players at all levels in the sport of baseball using a hard baseball and a leather glove, fundamentals are oftentimes not properly learned due to the fear associated with a hard ball traveling towards an individual at high speeds.

Moreover, leather gloves are also inappropriate for use in wet environments, such as in a pool, at the beach or in the rain. Upon contact with water, leather gloves tend to become stiff, which adversely affects the flexibility and useability of the entire glove. Additionally, conventional leather gloves are unable to effectively protect the wearer's hand against moisture.

The present invention overcomes many of the disadvantages inherent in conventional leather gloves used in sports such as baseball.

SUMMARY OF THE INVENTION

It is an object of the present invention to provide a waterproof sports glove that may be used as a training tool for sports at all levels, such as baseball, in order to facilitate learning of fundamentals at a quicker rate.

It is another object of the present invention to provide a waterproof sports glove that may be used in wet environments without damaging the glove or adversely affecting the flexibility and useability of the glove.

It is yet another object of the present invention to provide a waterproof sports glove which may be manufactured easily and at low cost and which is rugged and durable in construction.

The foregoing and other objects of the present invention are carried out by a waterproof sports glove comprising a pair of superposed flexible pieces of substantially water-impervious material sealed together along the marginal edges thereof to define a hollow body having an open lower section configured to receive therethrough the hand of a user. The glove body is provided with two spaced-apart finger sections separated by a cut-out portion, and each of the finger sections comprises at least one finger compartment for accommodating at least one finger of the user's hand. A web of substantially water-impervious material is disposed within the cut-out portion and interconnects the finger sections.

BRIEF DESCRIPTION OF THE DRAWINGS

The foregoing summary, as well as the following detailed description of a preferred embodiment of the invention, will be better understood when read in conjunction with the accompanying drawings. For the purpose of illustrating the invention, there is shown in the drawings an embodiment which is presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Figure 1:
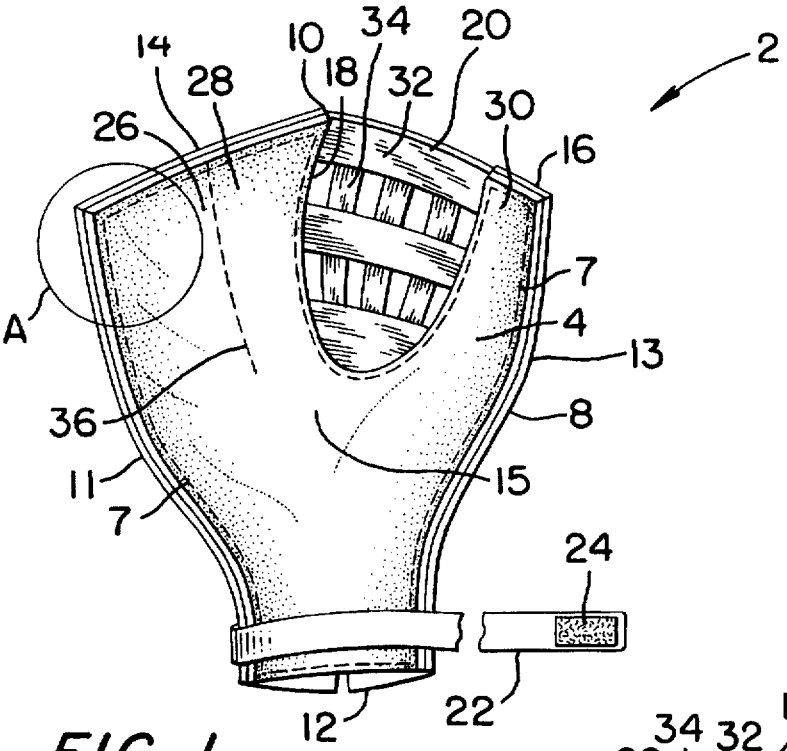
FIG. 1 is a front perspective view of a waterproof sports glove according to the present invention.
Figure 2:
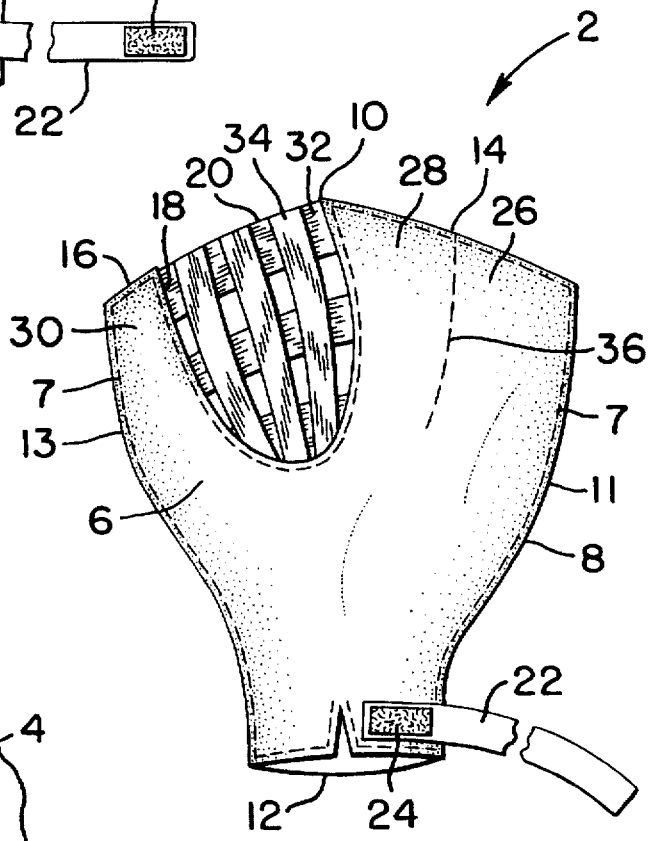
FIG. 2 is a rear perspective view of the waterproof sports glove shown in FIG. 1.
Figure 3:
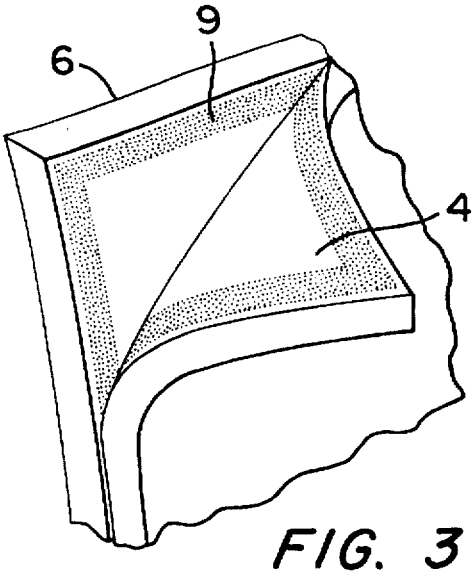
FIG. 3 is an enlarged fragmentary view of a corner portion of the waterproof sports glove shown within circle A in FIG. 1 showing the flexible pieces prior to sealing.

Referring now to the drawings in detail, wherein like numerals are used to indicate like elements throughout, there is shown in FIGS. 1–3 an embodiment of a waterproof sports glove, generally designated at 2, according to the present invention. For purposes of illustration, the glove 2 is shown as a right-hand glove for insertion on a user's right hand, and it is understood that the invention is equally applicable to left- and right-hand gloves. The waterproof sports glove comprises a pair of superposed thin, flexible pieces 4,6 composed of substantially water-impervious material and sealed together along the marginal edge portions thereof to define a curved, hollow glove body 8. The flexible pieces 4,6 correspond to the palm and the back, respectively, of a user's hand. The flexible palm piece 4 is similar in shape to but is slightly smaller in size than the flexible back piece 6. This feature imparts to the hollow glove body 8, and thus to the glove 2, a prestressed bow or curvature as further described below.

According to the present embodiment, as shown in FIGS. 1–2, the marginal edges of the flexible pieces 4,6 are sealed by a sewing process along a stitch line 7. However, since stitching of the flexible pieces 4,6 produces holes in the flexible pieces, additional means is required for sealing the flexible pieces in a waterproof manner. Accordingly, as shown in FIG. 3, the marginal edges of the flexible pieces 4,6 are heat sealed using a suitable adhesive 9, for example thermoplastic synthetic resin adhesives or thermosetting synthetic resin adhesives. However, it is understood by those skilled in the art that other suitable means may be used for waterproof sealing the stitched marginal edges of the flexible pieces 4,6. For example, after the stitching process, the marginal edges may be sealed with a seam sealer, waterproof tape or the like.

Preferably, a synthetic rubber material, such as neoprene, is used as the water-impervious material for the flexible pieces 4,6. Neoprene is a non-porous synthetic rubber material which not only exhibits excellent waterproof properties, but also has a desirable flexibility property which permits it to be repeatedly elastically deformed without damage or permanent deformation while providing structural integrity to the glove body 8. However, it is understood by those skilled in the art that other synthetic rubber materials exhibiting the above properties may be used for the flexible pieces 4,6.

As shown in FIGS. 1–2, the hollow glove body 8 is provided with a sealed upper section 10, sealed side sections 11, 13 and an open lower section 12 configured to receive therethrough the hand of a user during use of the glove 2. Two spaced finger sections 14,16 extend upwardly from a palm section 15 and terminate at their upper ends in the upper section 10 of the hollow glove body 8, the two finger sections 14,16 being separated by a U-shaped cut-out portion 18. A web 20 of substantially water-impervious material is disposed within the cut-out portion 18 and interconnects the two finger sections 14,16. An anchor strap 22 is attached to the flexible piece 6 at the open lower section 12 of the hollow glove body 8 for securing the waterproof glove 2 to the hand of a user. The anchor strap 22 is provided with suitable connecting means, such as Velcro connector portions 24, and is dimensioned to be wrapped around the open lower section 12 of the hollow glove body 8 to releasably secure the glove 2 to the hand of a user.

In the present embodiment, the finger section 14 comprises two finger compartments 26,28 and the finger section 16 comprises one finger compartment 30 for accommodating the fingers of the hand of a user. For example, in this embodiment the finger compartment 26 is dimensioned to receive therein the little finger, the ring finger and the middle finger, the finger compartment 28 is dimensioned to receive the index finger, and the finger compartment 30 is dimensioned to receive the thumb of the user's right hand. It is understood by those skilled in the art that other numbers of finger compartments may be utilized, if desired. For example, four individual finger compartments may be provided for respective ones of the little finger, the ring finger, the middle finger and the index finger of a hand, or one finger compartment may be provided for accommodating all four fingers.

As shown in FIGS. 1–2, the web 20 comprises a plurality of horizontal and vertical thin strips 32,34, which are likewise preferably formed of flexible water-impervious material. The strips 32,34 are arranged in a crisscross or lattice pattern and stitched together at their intersections to define a pocket configured to receive a ball, such as a tennis ball or the like. In the present embodiment, the pocket comprises three horizontal strips 32 and three vertical strips 34. However, it is understood that any other number of strips may be used without departing from the spirit and scope of the invention.

The opposite ends of the horizontal strips 32 are inserted in between the overlying, opposed edges of the flexible pieces 4 and 6 and secured thereto by stitching at the same time the two flexible pieces are stitched together. Similarly, the lower ends of the vertical strips 34 are inserted in between the overlying, opposed edges of the flexible pieces 4 and 6 and attached thereto by stitching during stitching together of the two flexible pieces. Preferably, the flexible water-impervious material for the strips 32,34 is the same as described above with respect to the flexible pieces 4,6.

The construction of the waterproof sports glove according to the present embodiment will be explained below with reference to FIGS. 1–3.

The flexible pieces 4,6 are first cut from a suitable thin synthetic rubber material, such as neoprene, either manually or with an industrial cutting machine, using a pattern generally resembling the shape of a hand. As noted previously, the flexible piece 4 has the same shape as but a slightly smaller size than the flexible piece 6. The cut-out portion 18 is preferably cut out during the cutting operation which forms the flexible pieces 4,6 though the cut-out portion 18 may be cut out separately. The horizontal and vertical strips 32,34 are also cut from synthetic rubber material and arranged in a lattice pattern to form the web 20 as shown in FIGS. 1–2.

The flexible pieces 4,6 are superposed and sewn together, as shown by the stitch line 7 in FIGS. 1–2, along the marginal edge portions thereof at the upper section 10 and the side sections 11,13 to form the glove body 8 using, for example, an industrial sewing machine. Before sewing together the flexible pieces 4,6, the strips 32,34 are inserted between the overlying inserted edges of the pieces 4,6 and a suitable adhesive 9 is applied to the marginal edge portions of the pieces 4,6 (excluding the edge portions at the bottom, open section 12). During the sewing process, the smaller flexible piece 4 is elastically stretched to the size of the larger flexible piece 6. After the sewing process is completed, the tension applied to the stretched flexible piece 4 is released, whereby the flexible piece 4 contracts to some degree as it seeks to return to its original size. The contraction of the flexible piece 4 is resisted by the larger flexible piece 6 which is sewn to the piece 4, whereby the piece 6 undergoes some degree of stretching as the piece 4 contracts thereby imparting a prestressed curvature or bow to the glove body 8. Then the flexible pieces 4,6 are sewn at a stitch line 36 to form the finger compartments 26, 28.

Instead of, or in addition to, applying the adhesive 9 to the marginal edge portions of the flexible pieces 4,6, a suitable seam sealer, waterproof tape or other sealing means may be applied over the stitching 7 to ensure the waterproofness of the glove 2.

It will be appreciated by those skilled in the art that the sports glove 2 according to the present invention may be used to catch tennis balls and the like near crowds or indoors without the inherent risks associated with a hard baseball and leather glove. The sports glove is also well suited as a training tool for sports at all levels, such as baseball, to permit the learning of fundamentals adequately and at a quicker rate.

Moreover, the present invention provides a waterproof sports glove which is particularly well adapted for use in wet environments without damaging the glove or adversely affecting the flexibility and useability of the glove, and which may be manufactured easily and at low cost and which is rugged and durable in construction.

From the foregoing description, it can be seen that the present invention comprises an improved waterproof sports glove. It will be appreciated by those skilled in the art that obvious changes could be made to the embodiment described in the foregoing description without departing from the broad inventive concept thereof. It is understood, therefore, that this invention is not limited to the particular embodiment disclosed, but is intended to cover all obvious modifications thereof which are within the scope and spirit of the invention as defined by the appended claims.

What is claimed is:

1. A waterproof sports glove for use by a user, comprising: two separate flexible pieces of non-porous, water-impervious material superposed on one another and connected and sealed together along marginal edge portions thereof to define a glove body having an open lower section configured to receive therethrough the hand of a user during use of the glove, the glove body having two finger sections separated from one another by a cut-out portion, each of the finger sections comprising at least one finger compartment for receiving therein at least one finger of the user's hand; and a web of a non-porous, water-impervious material disposed within the cut-out portion and interconnecting the two finger sections.

2. A waterproof sports glove as claimed in claim 1; further comprising an anchor strap attached to one of the pieces for securing the glove to the hand of the user.

3. A waterproof sports glove as claimed in claim 1; wherein one of the pieces has a similar shape and smaller size than the other of the pieces thereby imparting a prestressed curvature to the glove body due to the connection of the two pieces along the marginal edge portions thereof.

4. A waterproof sports glove as claimed in claim 3; wherein the two pieces comprise back and palm parts, respectively, corresponding to back and palm parts of the user's hand.

5. A waterproof sports glove as claimed in claim 1; wherein the water-impervious material of the pieces comprises synthetic rubber.

6. A waterproof sports glove as claimed in claim 5; wherein the synthetic rubber comprises neoprene.

7. A waterproof sports glove as claimed in claim 1; wherein the web comprises a plurality of strips of flexible material arranged in a lattice pattern defining a pocket for receiving a ball therein.

8. A waterproof sports glove as claimed in claim 7; wherein the flexible material comprises synthetic rubber.

9. A waterproof sports glove as claimed in claim 8; wherein the synthetic rubber comprises neoprene.

10. A waterproof sports glove as claimed in claim 1; wherein one of the finger sections comprises a single finger compartment, and the other of the finger sections comprises at least two finger compartments.

11. A waterproof sports glove for use by a user, comprising: two separate flexible pieces of non-porous, water-impervious material superposed on one another and connected and sealed together along marginal edge portions thereof to define a glove body having an open lower section configured to receive therethrough the hand of a user during use of the glove, one of the pieces having a similar shape and smaller size than the other of the pieces thereby imparting a prestressed curvature to the glove body due to the connection of the two pieces along the marginal edge portions thereof, the glove body having two finger sections separated from one another by a cut-out portion, each of the finger sections comprising at least one finger compartment for receiving therein at least one finger of the user's hand; a web of non-porous, water-impervious material disposed within the cut-out portion and interconnecting the two finger sections; and securing means attached to one of the pieces for releasably securing the glove to the hand of the user.

12. A waterproof sports glove as claimed in claim 11; wherein the water-impervious material comprises synthetic rubber.

13. A waterproof sports glove as claimed in claim 12; Wherein the synthetic rubber comprises neoprene.

14. A waterproof sports glove as claimed in claim 11; wherein one of the finger sections comprises a single finger compartment, and the other of the finger sections comprises at least two finger compartments.

15. A waterproof sports glove as claimed in claim 11; wherein the web comprises a plurality of strips of flexible material arranged in a lattice pattern defining a pocket for receiving a ball therein.

16. A waterproof sports glove as claimed in claim 15; wherein the flexible material comprises synthetic rubber.

17. A waterproof sports glove as claimed in claim 16; wherein the synthetic rubber comprises neoprene.

18. A waterproof sports glove as claimed in claim 1; wherein the marginal edge portions of the flexible pieces are connected and sealed together with an adhesive and sewn along a stitch line.

19. A waterproof sports glove as claimed in claim 1; wherein the web comprises first and second strips of flexible material arranged in a lattice pattern defining a pocket for receiving a ball therein, each of the first strips having opposite ends disposed in between the superposed marginal edge portions of the flexible pieces, and each of the second strips having an end disposed in between the superposed marginal edge portions of the flexible pieces.

20. A waterproof sports glove as claimed in claim 11; wherein the marginal edge portions of the flexible pieces are connected and sealed together with an adhesive and sewn along a stitch line.

21. A waterproof sports glove as claimed in claim 11; wherein the web comprises first and second strips of flexible material arranged in a lattice pattern defining a pocket for receiving a ball therein, each of the first strips having opposite ends disposed in between the superposed marginal edge portions of the flexible pieces, and each of the second strips having an end disposed in between the superposed marginal edge portions of the flexible pieces.

22. A sports glove for use by a user, comprising: two separate flexible pieces of non-porous, water-impervious material superposed on one another and connected and sealed together along marginal edge portions thereof with an adhesive and sewn along a stitch line to define a glove body having an open lower section configured to receive therethrough the hand of a user during use of the glove, one of the pieces having a similar shape and smaller size than the other of the pieces thereby imparting a prestressed curvature to the glove body due to the connection of the two pieces along the marginal edge portions thereof, the glove body having two finger sections separated from one another by a cut-out portion, each of the finger sections comprising at least one finger compartment for receiving therein at least one finger of the user's hand; and a web of non-porous, water-impervious material disposed within the cut-out portion and interconnecting the two finger sections.

23. A sports glove as claimed in claim 22; wherein the web comprises first and second strips of flexible material arranged in a lattice pattern defining a pocket for receiving a ball therein, each of the first strips having opposite ends disposed in between the superposed marginal edge portions of the flexible pieces, and each of the second strips having an end disposed in between the superposed marginal edge portions of the flexible pieces.

24. A sports glove as claimed in claim 23; wherein the material of the flexible pieces and the web comprises neoprene.

25. A waterproof sports glove as claimed in claim 1; wherein the flexible pieces of non-porous, water-impervious material provide structural integrity to the glove body when sealed together along the marginal edge portions.

26. A waterproof sports glove as claimed in claim 11; wherein the flexible pieces of non-porous, water-impervious material provide structural integrity to the glove body when sealed together along the marginal edge portions.

27. A waterproof sports glove as claimed in claim 22; wherein the non-porous, water-impervious material of the flexible pieces comprises synthetic rubber.

28. A waterproof sports glove as claimed in claim 27; wherein the synthetic rubber comprises neoprene.

29. A waterproof sports glove as claimed in claim 22; wherein the flexible pieces of non-porous, water-impervious material provide structural integrity to the glove body when sealed together with the adhesive and sewn along the stitch line along the marginal edge portions.

30. A waterproof sports glove as claimed in claim 25; wherein the non-porous, water-impervious material of the flexible pieces comprises synthetic rubber.

31. A waterproof sports glove as claimed in claim 30; wherein the synthetic rubber comprises neoprene.

32. A waterproof sports glove as claimed in claim 26; wherein the non-porous, water-impervious material of the flexible pieces comprises synthetic rubber.

33. A waterproof sports glove as claimed in claim 32; wherein the synthetic rubber comprises neoprene.

34. A waterproof sports glove as claimed in claim 1; further comprising securing means for securing the open lower section of the glove body to the hand of the user in a waterproof manner to substantially totally prevent liquid from entering into the finger compartments during use of the glove.

35. A waterproof sports glove as claimed in claim 11; wherein the securing means secures the open lower section of the glove body to the hand of the user in a waterproof manner to substantially totally prevent liquid from entering into the finger compartments during use of the glove.

36. A sports glove as claimed in claim 22; further comprising securing means for securing the open lower section of the glove body to the hand of the user in a waterproof manner to substantially totally prevent liquid from entering into the finger compartments during use of the glove.

37. A sports glove for use by a user, comprising:

two separate pieces of neoprene superposed on one another and connected and sealed together along marginal edge portions thereof with an adhesive and sewn along a stitch line to define a glove body having an open lower section configured to receive therethrough the hand of a user during use of the glove, the glove body having two finger sections separated from one another by a cut-out portion each of the finger sections comprising at least one finger compartment for receiving therein at least one finger of the user's hand; and securing means for securing the open lower section of the glove body to the hand of the user in a waterproof manner to substantially totally prevent liquid from entering into the finger compartments during use of the glove a web of non-porous, water-impervious material disposed within the cut-out portion and interconnecting the two finger sections.

38. A sports glove as claimed in claim 37; wherein one of the pieces of neoprene has a similar shape and smaller size than the other of the pieces of neoprene thereby imparting a prestressed curvature to the glove body due to the connection of the two pieces of neoprene along the marginal edge portions thereof.

39. A sports glove as claimed in claim 37; wherein the pieces of neoprene provide structural integrity to the glove body when sealed together with the adhesive and sewn along the stitch line along the marginal edge portions.

* * * * *